US008111234B2

(12) United States Patent
Tokuyasu

(10) Patent No.: US 8,111,234 B2
(45) Date of Patent: Feb. 7, 2012

(54) LIQUID CRYSTAL DISPLAY APPARATUS, LIQUID-CRYSTAL-DISPLAY CONTROLLING METHOD, AND COMPUTER PROGRAM

(75) Inventor: Ryoichi Tokuyasu, Tokyo (JP)

(73) Assignee: Sony Corporation, Tokyo (JP)

( * ) Notice: Subject to any disclaimer, the term of this patent is extended or adjusted under 35 U.S.C. 154(b) by 1092 days.

(21) Appl. No.: 11/928,930

(22) Filed: Oct. 30, 2007

(65) Prior Publication Data

US 2008/0150883 A1 Jun. 26, 2008

(30) Foreign Application Priority Data

Dec. 26, 2006 (JP) ..... 2006-348862

(51) Int. Cl.
*G09G 3/36* (2006.01)

(52) U.S. Cl. ..... 345/102

(58) Field of Classification Search ..... 345/87–104, 345/204

See application file for complete search history.

(56) References Cited

U.S. PATENT DOCUMENTS

| | | | | |
|---|---|---|---|---|
| 6,590,561 | B1 * | 7/2003 | Kabel et al. | 345/102 |
| 6,703,998 | B1 * | 3/2004 | Kabel et al. | 345/102 |
| 2002/0057252 | A1 * | 5/2002 | Onodera | 345/102 |

FOREIGN PATENT DOCUMENTS

| | | |
|---|---|---|
| JP | 5-173108 | 7/1993 |
| JP | 8-317250 | 11/1996 |
| JP | 9-80378 | 3/1997 |
| JP | 11-194736 | 7/1999 |
| JP | 2002-323690 | 11/2002 |
| JP | 2003-36063 | 2/2003 |
| JP | 2004-177547 | 6/2004 |
| JP | 3591213 | 9/2004 |
| JP | 2004-325628 | 11/2004 |
| JP | 2006-133750 | 5/2006 |

* cited by examiner

*Primary Examiner* — Sumati Lefkowitz
*Assistant Examiner* — Robert E Carter, III
(74) *Attorney, Agent, or Firm* — Oblon, Spivak, McClelland, Maier & Neustadt, L.L.P.

(57) ABSTRACT

A liquid crystal display apparatus including a liquid crystal display as a display unit, including the following elements: a backlight configured to illuminate the display unit from the back; and a controller configured to receive display-unit-brightness specifying information input from a user input unit and to adjust output of the backlight and contrast or Y gain of display data for the display unit in accordance with the brightness specifying information. The controller is configured to compare the brightness specifying information input by a user with a predetermined threshold, and, in the case where the brightness specifying information specifies brightness less than or equal to the threshold, adjust the contrast or the Y gain of the display data for the display unit.

10 Claims, 11 Drawing Sheets

LIQUID CRYSTAL DISPLAY APPARATUS, LIQUID-CRYSTAL-DISPLAY CONTROLLING METHOD, AND COMPUTER PROGRAM

CROSS REFERENCES TO RELATED APPLICATIONS

The present invention contains subject matter related to Japanese Patent Application JP 2006-348862 filed in the Japanese Patent Office on Dec. 26, 2006, the entire contents of which are incorporated herein by reference.

BACKGROUND OF THE INVENTION

1. Field of the Invention

The present invention relates to liquid crystal display apparatuses, liquid-crystal-display control methods, and computer programs, and more particularly, to a liquid crystal display apparatus capable of performing a display control operation on a liquid crystal display to improve visibility, a liquid-crystal-display control method, and a computer program.

2. Description of the Related Art

Liquid crystal displays are flat, lightweight displays and consume low power. Because of these advantages, the liquid crystal displays are used in various apparatuses, such as televisions (TVs), personal computers (PCs), and cameras. Since the liquid crystal displays are not luminescent, backlights are used in transmissive liquid crystal displays to illuminate display screens from the back in order to improve the visibility and to be usable even in dark places. Exemplary backlights include fluorescent lamps, light-emitting diodes (LEDs), and the like. With the use of backlights, however, the image quality is deteriorated.

In the related art, for example, Japanese Patent No. 3591213 describes a method of adjusting the brightness without sacrificing the image quality by performing a display control operation on a liquid crystal display and additionally controlling the output intensity of a backlight.

In the case where a fluorescent lamp is used as a backlight, adjustment of luminance is difficult to perform. In the case where an LED is used as a backlight, fine adjustment of brightness involves a high-performance circuit, resulting in an increase in the cost. A general, inexpensive backlight adjustment circuit has difficulty in sufficiently reducing the voltage of an object to be controlled because of transistor saturation. As a result, the lower limit of a backlight brightness adjustable range is set to a relatively high level. An apparatus including such a circuit fails to set the brightness adjustment range to a sufficiently wide range, and it becomes difficult to avoid degradation of the image quality due to the use of the backlight. In particular, the use of the backlight in a dark environment causes an insufficient reduction in the brightness, which may in turn cause deterioration of the visibility.

SUMMARY OF THE INVENTION

It is desirable to provide a liquid crystal display apparatus realizing a highly visible display control operation on a liquid crystal display even in the case where the range in which brightness is adjusted using a drive circuit for adjusting the brightness of a backlight auxiliary to the liquid crystal display apparatus is limited, a liquid-crystal-display control method, and a computer program.

According to an embodiment of the present invention, there is provided a liquid crystal display apparatus including a liquid crystal display as a display unit, including the following elements: a backlight configured to illuminate the display unit from the back; and a controller configured to receive display-unit-brightness specifying information input from a user input unit and to adjust output of the backlight and contrast or Y gain of display data for the display unit in accordance with the brightness specifying information. The controller is configured to compare the brightness specifying information input by a user with a predetermined threshold, and, in the case where the brightness specifying information specifies brightness less than or equal to the threshold, adjust the contrast or the Y gain of the display data for the display unit.

The controller may be configured to adjust the contrast or the Y gain of the display data for the display unit in the case where a level of the backlight corresponding to the brightness specified by the brightness specifying information is at or below a backlight adjustable minimum output level.

The controller may be configured to perform, selectively or in parallel, (a) adjustment of the output of the backlight, and (b) adjustment of the contrast or the Y gain of the display data for the display unit, in accordance with the brightness specifying information input by the user.

The controller may be configured to perform at least one of (a) adjustment of the output of the backlight, and (b) adjustment of the contrast or the Y gain of the display data for the display unit, and, to perform (a) and (b) in parallel at a point at which the adjustment being performed is switched from (a) to (b) or from (b) to (a).

The controller may be configured to control the brightness of the display unit by performing a signal control operation of boosting a halftone portion using a gamma correction circuit included in the liquid crystal display apparatus.

In the case where (1) the display unit is changed from a bright state to a dark state, and (2) the display unit is changed from a dark state to a bright state, the controller may be configured to perform, selectively or in parallel, (a) adjustment of the output of the backlight, and (b) adjustment of the contrast or the Y gain of the display data for the display unit, and, to set the point at which the adjustment being performed is switched from (a) to (b) or from (b) to (a) and the point at which (a) and (b) are performed in parallel to be different in (1) and (2).

According to another embodiment of the present invention, there is provided a liquid-crystal-display control method for performing, with a liquid crystal display apparatus including a liquid crystal display as a display unit, a control operation on the display unit, including the step of receiving, with a controller, display-unit-brightness specifying information input from a user input unit and adjusting output of a backlight that illuminates the display unit from the back and contrast or Y gain of display data for the display unit in accordance with the brightness specifying information. When the brightness of the display unit is controlled, the brightness specifying information input by a user is compared with a predetermined threshold, and, in the case where the brightness specifying information specifies brightness less than or equal to the threshold, the contrast or the Y gain of the display data for the display unit is adjusted.

When the brightness of the display unit is controlled, the contrast or the Y gain of the display data for the display unit may be adjusted in the case where a level of the backlight corresponding to the brightness specified by the brightness specifying information is at or below a backlight adjustable minimum output level.

When the brightness of the display unit is controlled, (a) adjustment of the output of the backlight and (b) adjustment of the contrast or the Y gain of the display data for the display unit may be performed selectively or in parallel in accordance with the brightness specifying information input by the user.

According to another embodiment of the present invention, there is provided a computer program allowing a liquid crystal display apparatus including a liquid crystal display as a display unit to perform a control operation on the display unit, the control operation including the step of allowing a controller to adjust output of a backlight that illuminates the display unit from the back and contrast or Y gain of display data for the display unit in accordance with display-unit-brightness specifying information input from a user input unit. When the brightness of the display unit is controlled, the controller is allowed to compare the brightness specifying information input by a user with a predetermined threshold, and, in the case where the brightness specifying information specifies brightness less than or equal to the threshold, adjust the contrast or the Y gain of the display data for the display unit.

The computer program according to the embodiment of the present invention is a computer program provided to a general-purpose computer system that can execute various program codes by a computer-readable storage medium, such as a compact disc (CD), a Floppy Disk® (FD), a magneto-optical (MO) disc, or a communication medium, such as a network. By providing such a program in a computer-readable format, the processing associated with the program can be executed on the computer system.

Further features and advantages of the embodiments of the present invention will become apparent from detailed description based on the later-described embodiments of the present invention and the appended drawings. Note that the term "system" in this specification is a logical set of a plurality of apparatuses and is not limited to the structure in which these apparatuses are accommodated in a single housing.

According to the embodiments of the present invention, the brightness of a liquid crystal display is adjusted by adjusting the output of a backlight and adjusting the contrast or Y gain. In particular, the contrast or Y gain is adjusted in the case where a level of the backlight corresponding to the brightness specified by the brightness specifying information is at or below a backlight adjustable minimum output level, the visibility of display data for a display unit can be improved in a dark environment. In the case where the adjustment of the backlight output is switched to the adjustment of the contrast or Y gain and vice versa, the adjustment of the backlight output and the adjustment of the contrast or Y gain are performed in parallel. Accordingly, the display unit can be controlled smoothly without making the point at which the adjustment being performed is switched noticeable.

DESCRIPTION OF THE PREFERRED EMBODIMENTS

Figure 1:
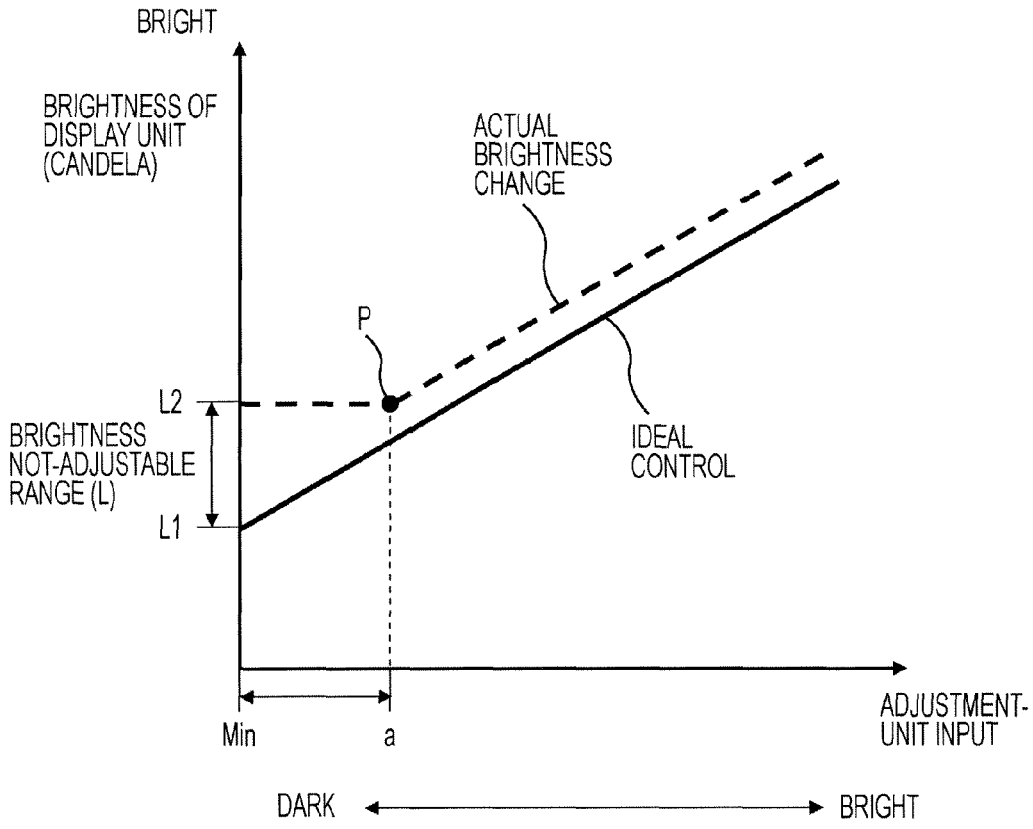
FIG. 1 illustrates an actual change in brightness of a display unit in the case where brightness adjustment of a general liquid crystal display is performed.

A liquid crystal display apparatus, a liquid-crystal-display control method, and a computer program according to embodiments of the present invention will now be described in detail with reference to the drawings. Liquid crystal displays are used in various apparatuses, such as TVs, PCs, and cameras. In particular, since the liquid crystal displays are lightweight and consume low power, they are used in many portable apparatuses.

Portable apparatuses are used in various environments, such as outdoors in bright sun, outdoors in the evening, and indoors. The optimal brightness of a screen of a liquid crystal display greatly changes in accordance with the brightness of its surroundings. For example, in the case where a liquid crystal display is used indoors in the evening, its surroundings are relatively dark. In such a dark environment, the visibility of an image can be improved by displaying the image with reduced brightness, that is, at a lower luminance level, compared with the case in which the liquid crystal display is used in a very bright environment such as outdoors in direct sunlight. In contrast, in a very bright environment such as outdoors in direct sunlight, the visibility of an image can be improved by displaying the image with increased brightness, that is, at a higher luminance level.

The brightness adjustment of the liquid crystal display is performed by controlling the brightness of a backlight, as has been described above. However, many widely-used, inexpensive backlight adjustment circuits are configured to switch the brightness of the backlight between two levels or among three levels. In other words, these backlight adjustment circuits fail to reduce the brightness to a sufficiently low level. With the use of these backlight adjustment circuits, even in the case where the brightness of the backlight is set to the minimum controllable level, the display screen with high visibility is difficult to achieve in a dark environment.

According to an embodiment of the present invention, for example, in the case where a desired level of a backlight is within the range where the brightness of the backlight is unchangeable, contrast (or Y gain) is reduced to adjust the brightness of the screen of the liquid crystal display, thereby reducing the apparent brightness. The Y gain is a luminance signal included in an image signal. In the following description, an adjustment process performed by a controller is described as a combination of backlight-output adjustment and contrast adjustment. The contrast adjustment is exchangeable with the Y gain adjustment. That is, increasing the contrast is exchangeable with increasing the Y gain, and decreasing the contrast is exchangeable with decreasing the Y gain.

In the case where the brightness of the screen is changed only by adjusting the contrast, the representation of gradation becomes poor. It is therefore preferable that the screen be adjusted by a method not depending solely on the contrast adjustment, if possible. Thus, the brightness is largely changed by adjusting the brightness of the backlight, and, if darkness achieved by the backlight brightness adjustment is insufficient, the apparent brightness is reduced by adjusting the contrast.

An embodiment of the present invention will now be described. A display control operation on a liquid crystal display according to the embodiment of the present invention is applicable to various apparatuses having liquid crystal displays, such as display apparatuses, PCs, TVs, cameras, and game machines. For example, a camera includes a liquid crystal panel that has a size of a few inches by a few inches and is placed on the back of the camera. Further, an electric viewfinder (EVF) of the camera includes a liquid crystal panel. The display control operation according to the embodiment is applicable to these liquid crystal displays.

A specific example of a display control operation performed with a liquid crystal display apparatus according to an embodiment of the present invention will be described. FIG. 1 illustrates a change in brightness of a display unit (liquid crystal display) in the case where brightness adjustment is performed with a general liquid crystal display apparatus. The axis of abscissa shows an input value entered by a user through a brightness adjustment unit (hereinafter may also be referred to as an "adjustment-unit input value") set in the liquid crystal display apparatus, and the axis of ordinate shows the brightness level of a screen displayed on the display unit.

The output of a backlight for the liquid crystal display is changed in accordance with a user input value entered through the brightness adjustment unit set in the liquid crystal display apparatus, thereby adjusting the brightness of the screen displayed on the display unit. Ideally, the brightness of the backlight is adjusted continuously in accordance with a user input. However, as has been described above, a general backlight-output control circuit is configured to only allow insufficient reduction in a control voltage due to the saturation of transistors included in the control circuit. Therefore, the minimum backlight adjustable brightness level is set to a relatively high level.

A solid line shown in FIG. 1 denotes an ideal control line, and a dotted line denotes the actual brightness change. In the drawing, there is a space between the solid line and the dotted line; however, the solid line and the dotted line overlap each other in a range where the two lines have the same slope (where the brightness is greater than or equal to [L2]).

As shown in FIG. 1, the brightness level is difficult to be reduced to be below the brightness [L2] corresponding to the point [P], and there is a brightness not-adjustable range from [L1] to [L2]. In the liquid crystal display apparatus with the control circuit with such characteristics, the minimum controllable brightness level of the display unit is [L2], and the brightness is difficult to be set to be below [L2]. That is, the brightness of the display unit is maintained at the minimum controllable brightness level [L2] in the case where the adjustment-unit input value is at or below the adjustment-unit input point [a]. As a result, as has been described above, the visibility of the display unit is deteriorated in a dark environment.

According to the structure of the liquid crystal display apparatus of the embodiment of the present invention, a display control operation is performed to improve the visibility in the case where a control point [P] corresponding to the adjustment-unit input value entered by the user is at or below the lower limit of the backlight brightness adjustment, that is, within the brightness not-adjustable range from [L1] to [L2].

Figure 2:
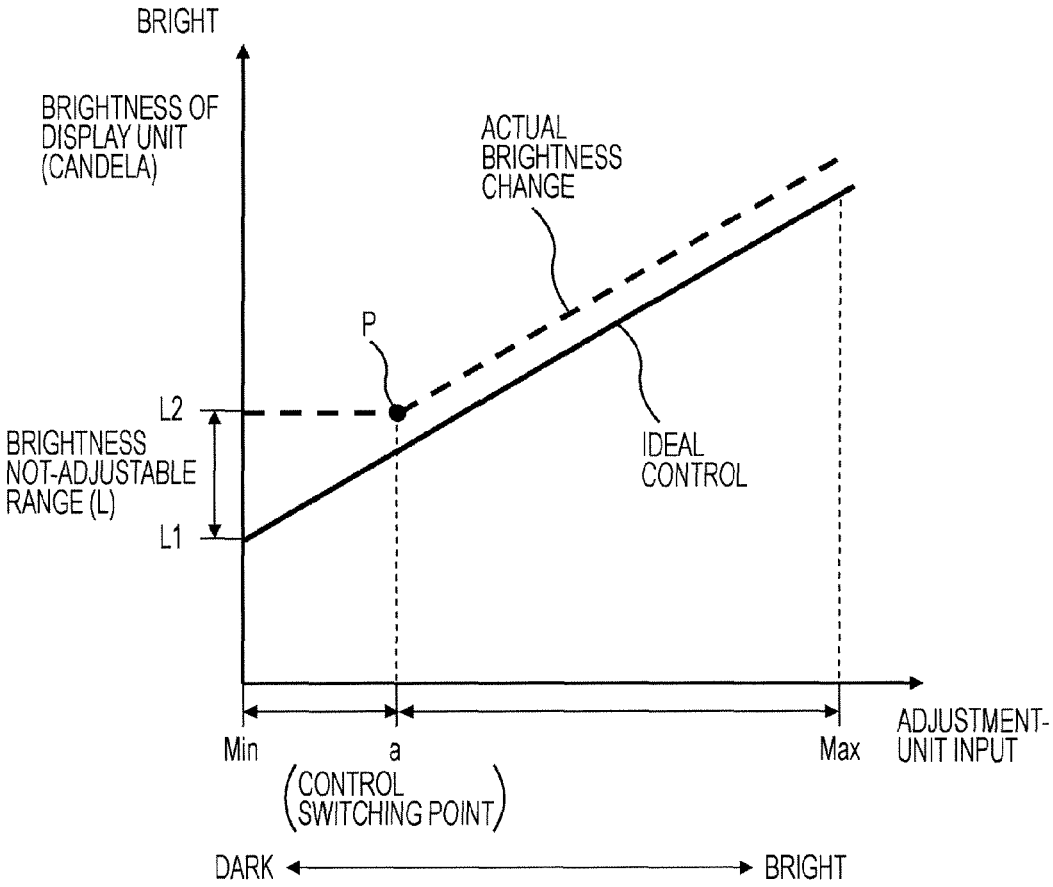
FIG. 2 illustrates a process in which a brightness control range is divided at an adjustment-unit input value [a] as a switching point.

That is, as shown in FIG. 2, the brightness control range is divided at the adjustment-unit input value [a] serving as a switching point. In the case where the adjustment-unit input value is at or below the adjustment-unit input value [a], the contrast is controlled in a state where the brightness of the backlight is fixed at a sufficiently low level. In the case where the adjustment-unit input value is larger than the adjustment-unit input value [a], the brightness of the backlight is controlled in a state in which the contrast is fixed at a sufficiently high level.

Figure 3A:
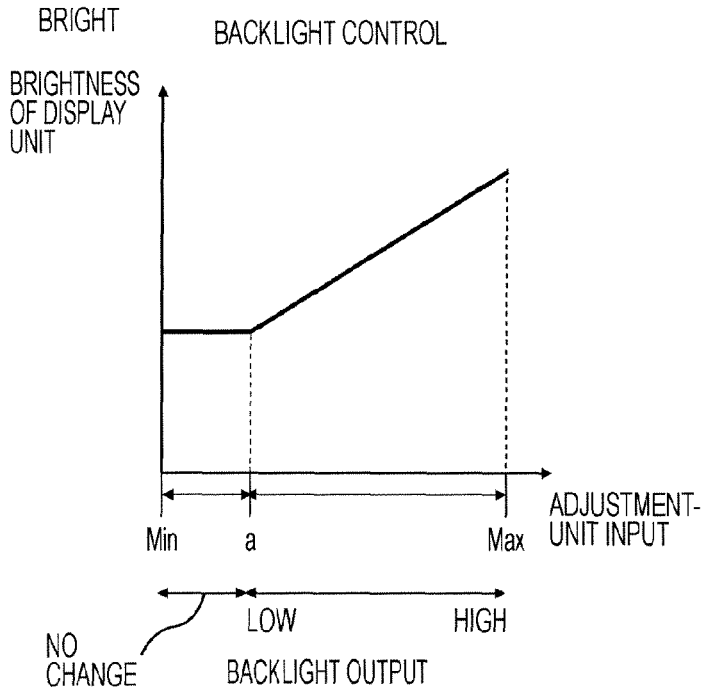
FIGS. 3A and 3B illustrate a display control process according to an embodiment of the present invention.
Figure 3B:
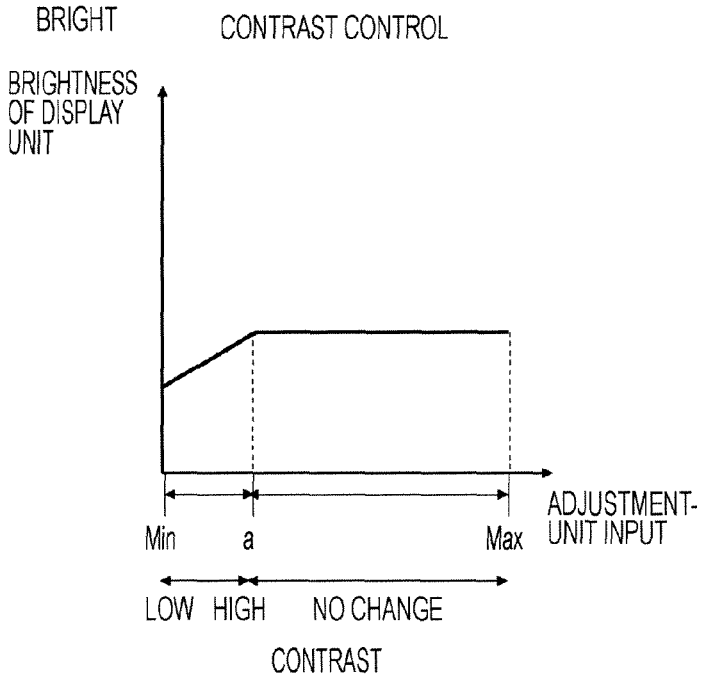

Specifically, a control operation shown in FIGS. 3A and 3B is performed. FIG. 3A illustrates an operation performed to adjust the brightness of the display unit by adjusting the backlight. FIG. 3B illustrates an operation performed to adjust the brightness of the display unit by adjusting the contrast. As shown in FIG. 3A, the backlight output is controlled in the case where the adjustment-unit input value is above the adjustment-unit input value [a]. That is, the backlight output is changed from low to high in accordance with an input value entered through the adjustment unit in the range of the adjustment-unit input value from [a] to [Max]. In the range of the adjustment-unit input value from [Min] to [a], the backlight output is fixed at the minimum level. In the range of the adjustment-unit input value from [a] to [Max], the brightness of the backlight is controlled in a state where the contrast is fixed at a sufficiently high level.

In contrast, a contrast control operation is performed in the case where the adjustment-unit input value is at or below the adjustment-unit input value [a], as illustrated in FIG. 3B. That is, the contrast is changed from low to high in accordance with an input value entered through the adjustment unit in the range of the adjustment-unit input value from [Min] to [a]. In this range, the contrast is controlled in a state in which the brightness of the backlight is fixed at a sufficiently low level. In the range of the adjustment-unit input value from [a] to [Max], the contrast is maintained at a constant level. In this range, only the backlight output is changed.

Figure 4A:
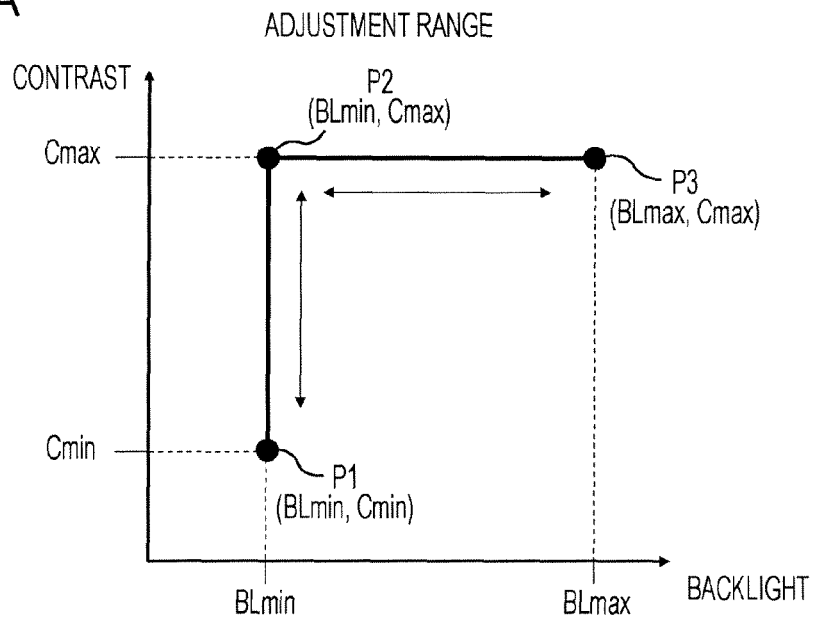
FIGS. 4A and 4B illustrate the range in which a backlight and contrast are controlled according to the embodiment.
Figure 4B:
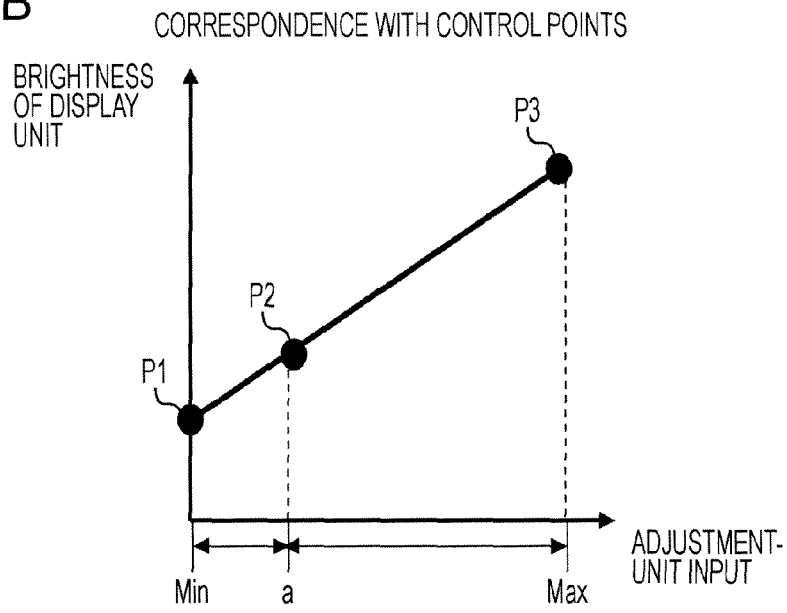

Referring to FIGS. 4A and 4B, a backlight-and-contrast control range will be described. FIG. 4A illustrates a backlight-and-contrast control range. In a control range from P1 to P2, the backlight value is set to the minimum value [BLmin], and the contrast value is changed from low [Cmin] to high [Cmax]. In a control range from P2 to P3, the contrast value is fixed at high [Cmax], and the backlight value is changed from the minimum value [BLmin] to the maximum value [BLmax].

As in FIGS. 2, 3A, and 3B, FIG. 4B shows a correspondence between the adjustment-unit input value (abscissa) and the brightness of the display unit (ordinate), and illustrates points corresponding to control points P1, P2, and P3 shown in FIG. 4A. That is, the range from the adjustment-unit minimum input value [Min] to the adjustment-unit input value [a] corresponding to the lower limit of the backlight output corresponds to the range from P1 to P2 shown in FIG. 4A. In this range, the backlight value is set to the minimum value [BLmin], and the contrast value is changed from low [Cmin] to high [Cmax]. The range from P2 to P3 shown in FIG. 4B corresponds to the range from the adjustment-unit input value [a] corresponding to the lower limit of the backlight output to the adjustment-unit maximum input value [Max]. In this range, the contrast value is maintained at a high level [Cmax], and the backlight value is changed from the minimum value [BLmin] to the maximum value [BLmax].

In a structure configured to perform such a control operation, an adjustment unit(s) which is(are) set in the apparatus and operated by a user can be set as a single adjustment unit. By configuring the controller included in the liquid crystal display apparatus to adjust the backlight output or the contrast by changing between the backlight adjustment and the contrast adjustment at the adjustment-unit input value [a] serving as a threshold, it becomes unnecessary for the user to enter a command to switch between the backlight adjustment and the contrast adjustment.

Figure 5:
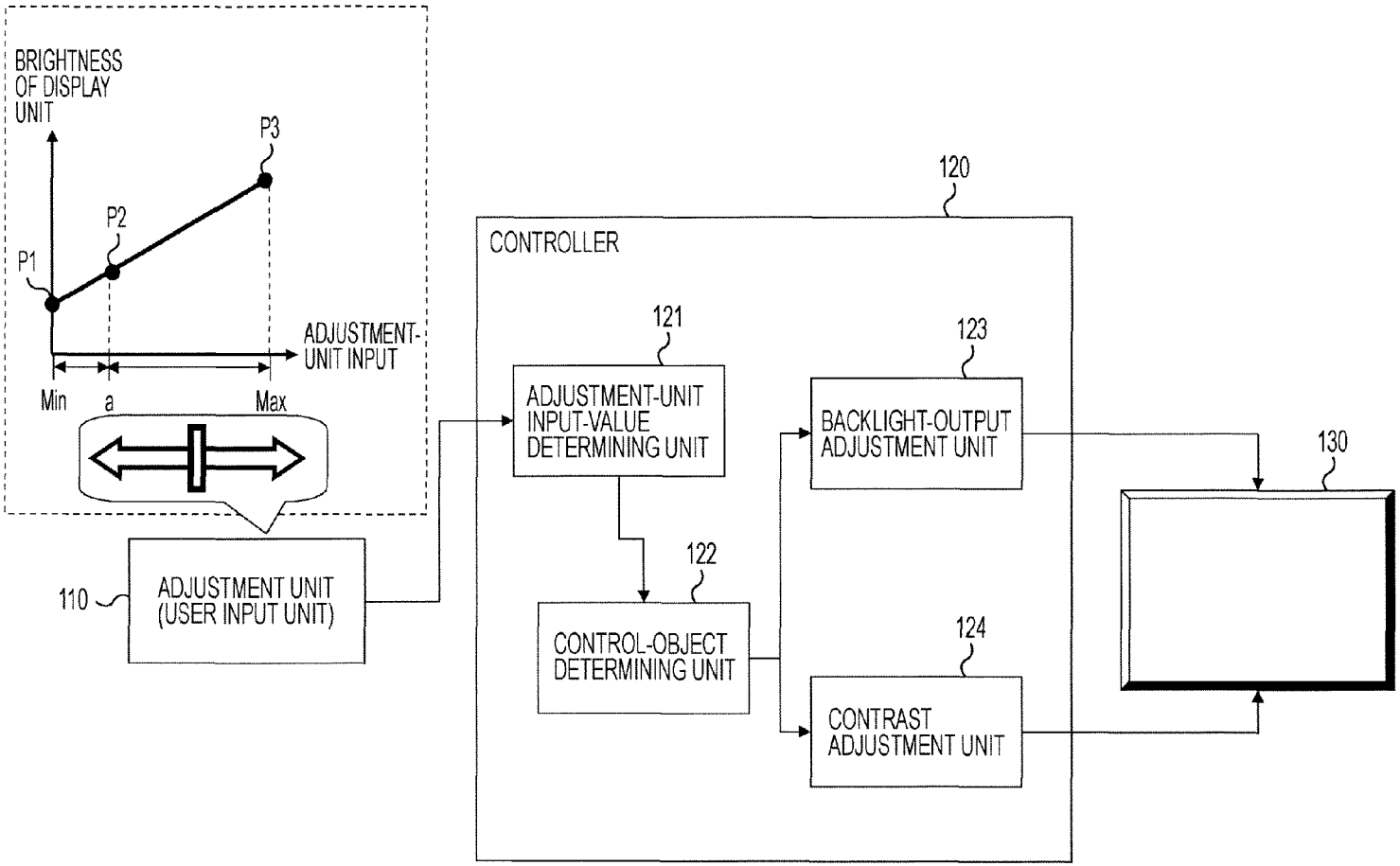
FIG. 5 is a block diagram of an exemplary structure of a controller for a display unit according to the embodiment.

More specifically, as shown in FIG. 5, user operation information entered to an adjustment unit 110 serving as a user input unit set in the apparatus is input to an adjustment-unit input-value determining unit 121 of a controller 120, and a setting value of the adjustment unit 110 is determined. The adjustment unit 110 serving as the user input unit can be configured in various forms including a slider, a dial, or a switch.

The adjustment-unit input-value determining unit 121 of the controller 120 determines the setting value of the adjustment unit 110. An input value entered through the adjustment unit 110 is within the range from the adjustment-unit minimum input value [Min] to the adjustment-unit maximum input value [Max], and the range includes the adjustment-unit input value [a] corresponding to the backlight controllable lower limit.

A control-object determining unit 122 of the controller 120 determines whether the setting value of the adjustment unit 110 is a value within (1) the range from the adjustment-unit minimum input value [Min] to [a] or (2) the range from [a] to the adjustment-unit maximum input value [Max]. On the basis of the determination result, the control-object determining unit 122 determines an object to be controlled.

In the case where the setting value of the adjustment unit 110 is within (1) the range from the adjustment-unit minimum input value [Min] to [a], a control signal is output to a contrast adjustment unit 124, and the contrast of a display unit 130 is adjusted. In the case where the setting value of the adjustment unit 110 is within (2) the range from [a] to the adjustment-unit maximum input value [Max], a control signal is output to a backlight-output adjustment unit 123, and the output of a backlight for the display unit 130 is adjusted. With this structure, the user can change the brightness of the display unit 130 without being aware of a change in the control point.

In the foregoing embodiment, only one of the backlight and the contrast is adjusted in accordance with an input value entered through the brightness adjustment unit, that is:

(1) Only the contrast is adjusted in the case where the adjustment-unit input value is within the range from the adjustment-unit minimum input value [Min] to [a]; and (2) Only the backlight output is adjusted in the case where the adjustment-unit input value is within the range from [a] to the adjustment-unit maximum input value [Max]. Alternatively, both the backlight and the contrast may be adjusted.

Figure 6A:
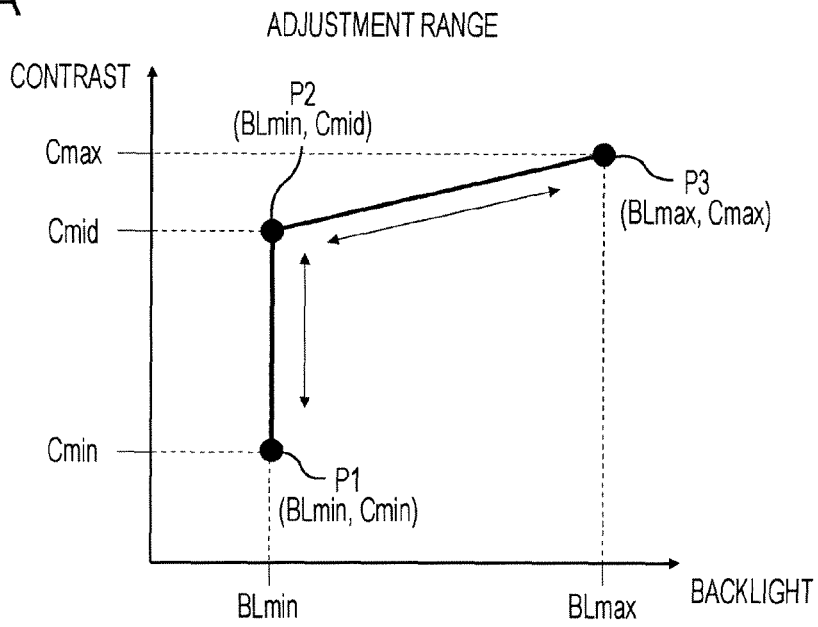
FIGS. 6A and 6B illustrate an exemplary display-unit control process of adjusting both the backlight and contrast.
Figure 6B:
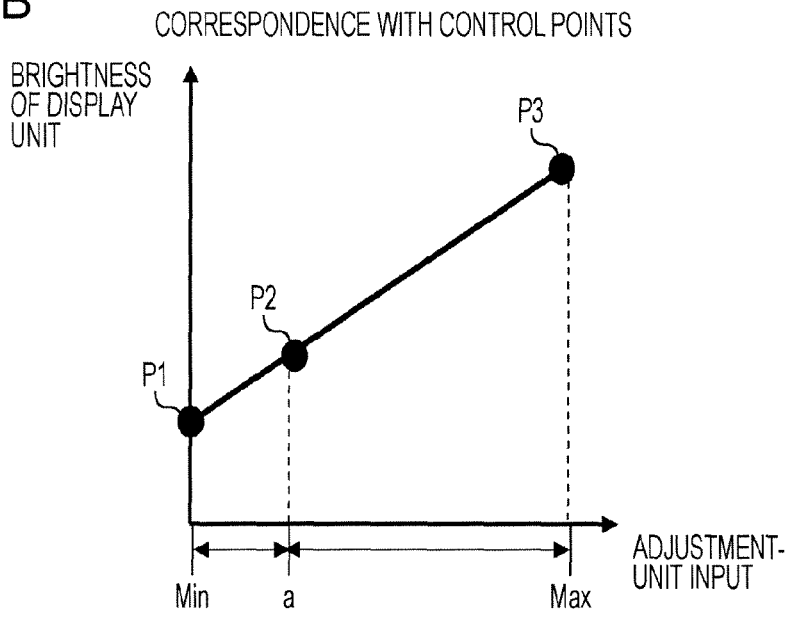

Referring now to FIGS. 6A and 6B, an example in which both the backlight and the contrast are adjusted will be described. FIG. 6A illustrates a backlight-and-contrast control range. In a control range from P1 to P2, the backlight value is set to the minimum value [BLmin], and the contrast value is changed from low [Cmin] to medium [Cmid]. In a control range from P2 to P3, the contrast value is changed from medium [Cmid] to high [Cmax], and the backlight value is changed from the minimum value [BLmin] to the maximum value [BLmax].

As in FIGS. 2, 3A, and 3B, FIG. 6B shows a correspondence between the adjustment-unit input value (abscissa) and the brightness of the display unit (ordinate), and illustrates points corresponding to control points P1, P2, and P3 shown in FIG. 6A. That is, the range from the adjustment-unit minimum input value [Min] to the adjustment-unit input value [a] corresponding to the lower limit of the backlight output corresponds to the range from P1 to P2 shown in FIG. 6A. In this range, the backlight value is set to the minimum value [BLmin], and the contrast value is changed from low [Cmin] to medium [Cmid]. The range from P2 to P3 shown in FIG. 6B corresponds to the range from the adjustment-unit input value [a] corresponding to the lower limit of the backlight output to the adjustment-unit maximum input value [Max]. In this range, the contrast value is changed from medium [Cmid] to high [Cmax], and the backlight value is changed from the minimum value [BLmin] to the maximum value [BLmax].

With such a control operation, both the backlight and the contrast are changed at the same time in the interval from P2 to P3 shown in FIG. 6B. Therefore, a change in the brightness seems more natural.

Figure 7A:
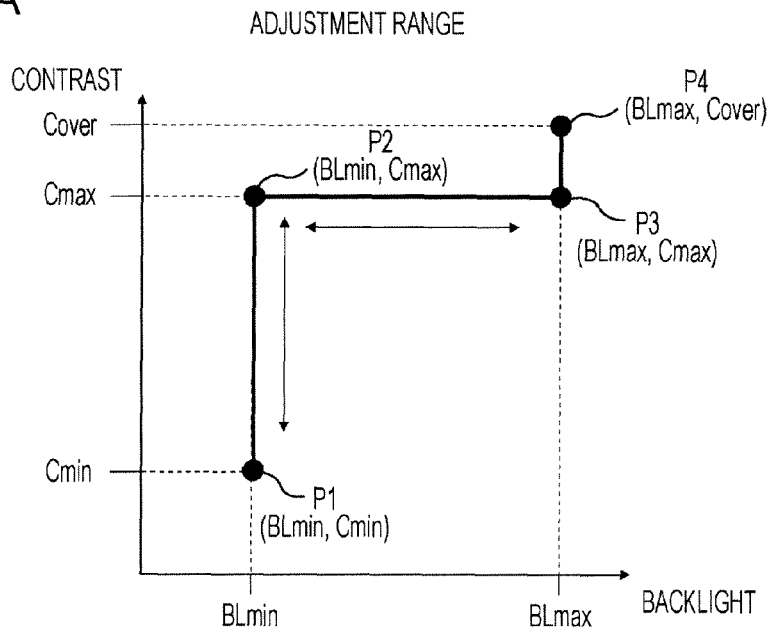
FIGS. 7A and 7B illustrate an exemplary display-unit control operation in which the contrast is further increased to a value larger than the rated maximum or a sufficiently large value [Cmax]
Figure 7B:
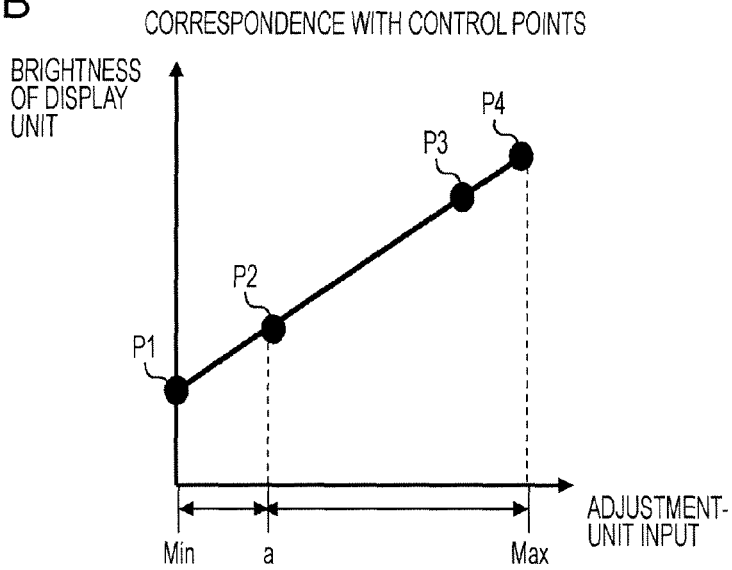

An example illustrated in FIGS. 7A and 7B is an exemplary display-unit control operation in which the contrast is further increased to a value larger than the rated maximum or a sufficiently large value [Cmax]. As illustrated in FIG. 7A, a control operation is performed to further move the control point from a preset point [P3] corresponding to the backlight maximum value [BLmax] and the contrast rated maximum or sufficiently large value [Cmax] to a control point [P4].

The control point [P4] is a point at which the contrast is larger than the contrast rated maximum or sufficiently large value [Cmax] and is set by a control operation to [BLmax, Cover]. At this control point [P4], a displayed image may be overexposed, but a brighter image can be obtained. The transition from P3 to P4 may be achieved by a structure configured to set the contrast to a value larger than the rated maximum. Preferably, however, instead of increasing the contrast, the transition from P3 to P4 may be achieved by a signal control operation performed by a gamma (γ) correction circuit to boost a halftone portion.

The γ correction circuit is a correction circuit configured to obtain an output signal in accordance with the characteristics of the liquid crystal display. The gamma (γ) value is the ratio of a change in brightness of an image to a change in voltage reduced value, and it is ideal to bring the gamma (γ) value closer to one and to be linear. Since the transmittance (T) characteristic of the liquid crystal display relative to an input voltage (V), which is the so-called V-T characteristic, is nonlinear, it is necessary to correct the characteristic to be linear. In order to reproduce a display image faithful to the original data, it is necessary to correct such an error. This is the gamma correction, and a correction circuit that performs this correction is the γ correction circuit. With a signal control operation performed by the γ correction circuit to boost a halftone portion, the brightness can be reproduced more brightly than the actual, and the transition from P3 [BLmax, Cmax] to P4 [BLmax, Cover] shown in FIG. 7A can be achieved.

Figure 8A:
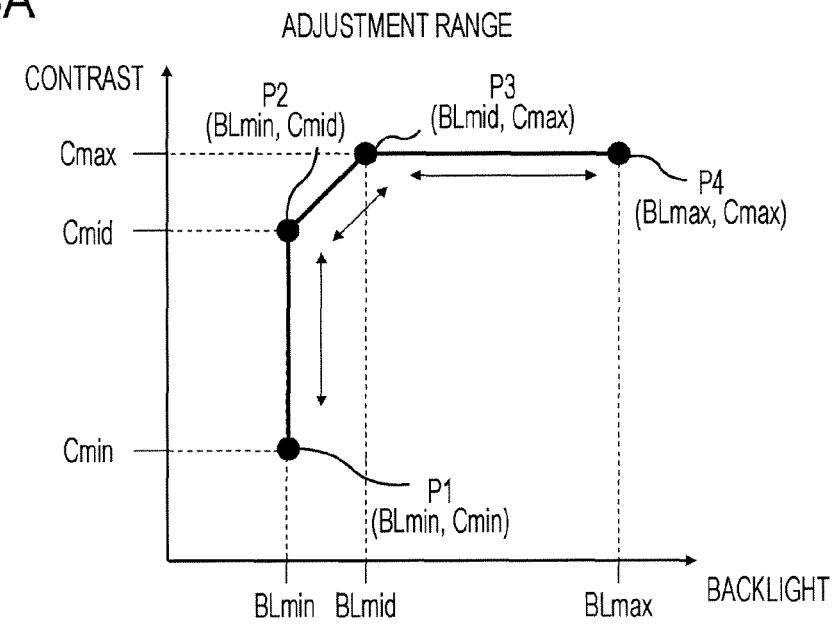
FIGS. 8A and 8B illustrate an exemplary display-unit control operation according to the embodiment.
Figure 8B:
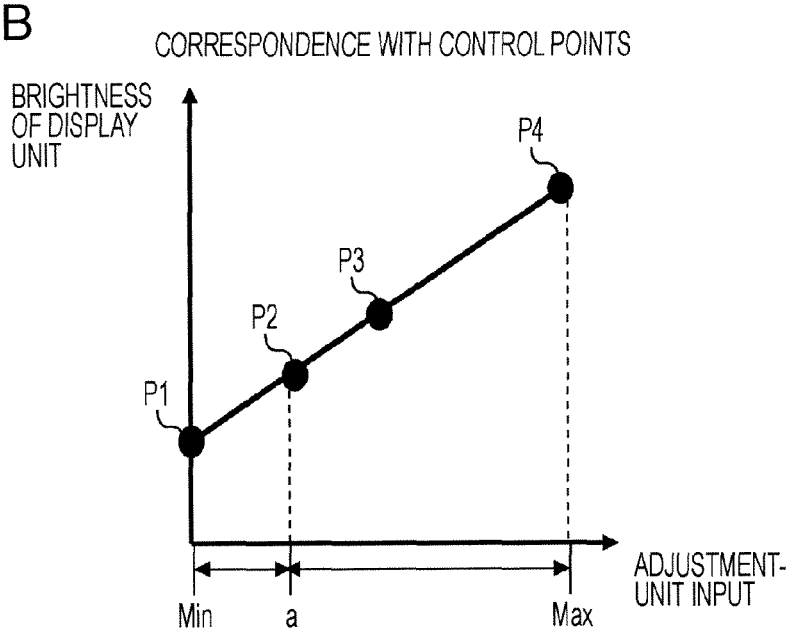

Alternatively, a control operation shown in FIGS. 8A and 8B may be performed. That is, in the range from P1 to P2, the contrast is adjusted between [Cmin] and [Cmid], and the backlight is fixed at [BLmin]. In the range from P2 to P3, the contrast is adjusted between [Cmid] and [Cmax], and the backlight is adjusted between [BLmin] and [BLmid]. In the range from P3 to P4, the contrast is fixed at [Cmax], and the backlight is adjusted between [BLmid] and [BLmax]. With this control operation, both the contrast and the backlight are adjusted in parallel at a switching point at which the adjustment being performed is switched from the contrast adjustment to the backlight adjustment. As a result, the switching point becomes less noticeable.

Figure 9A:
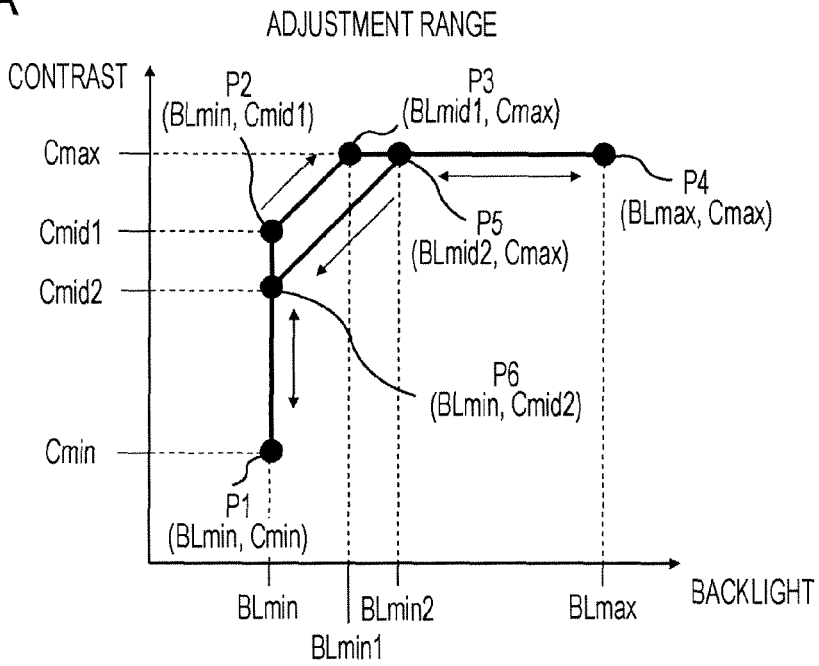
FIGS. 9A and 9B illustrate an exemplary display-unit control operation according to the embodiment.
Figure 9B:
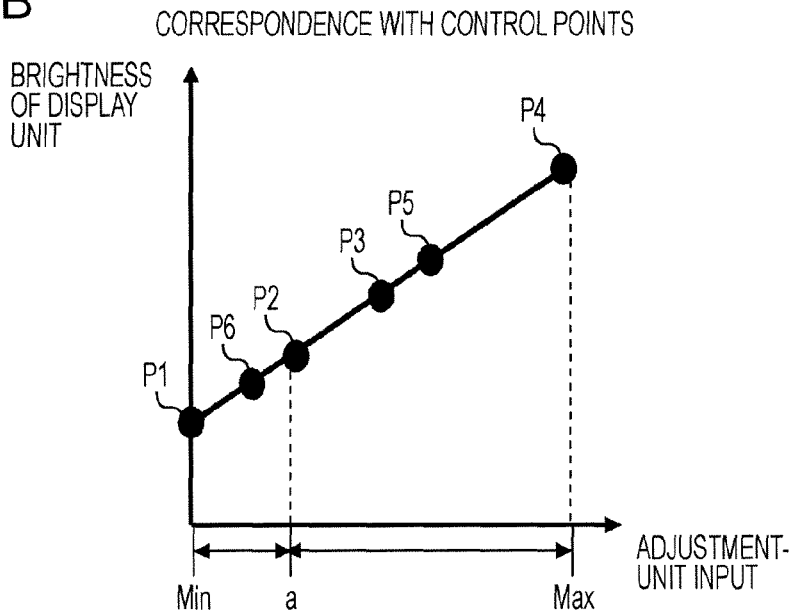

Alternatively, a control operation shown in FIGS. 9A and 9B may be performed. In the control operation shown in FIGS. 9A and 9B, different control paths are employed in increasing and decreasing the brightness of the display unit in the case where the user adjusts the brightness, and the setting has hysteresis effects. That is, (1) in a control operation of increasing the brightness of the display unit, in the range from P1 to P2, the contrast is adjusted between [Cmin] and [Cmid1], and the backlight is fixed at [BLmin]; in the range from P2 to P3, the contrast is adjusted between [Cmid1] and [Cmax], and the backlight is adjusted between [BLmin] and [BLmid1]; and in the range from P3 to P4, the contrast is fixed at [Cmax], and the backlight is adjusted between [BLmid1] and [BLmax].

(2) In a control operation of decreasing the brightness of the display unit, in the range from P4 to P5, the contrast is fixed at [Cmax], and the backlight is adjusted between [BLmax] and [BLmid2]; in the range from P5 to P6, the contrast is adjusted between [Cmax] and [Cmid2], and the backlight is adjusted between [BLmid2] and [BLmin]; and in the range from P6 to P1, the contrast is adjusted between [Cmid2] and [Cmin], and the backlight is fixed at [BLmin]. With these control operations, both the contrast and the backlight are adjusted in parallel at switching points at which the adjustment being performed is switched from the contrast adjustment to the backlight adjustment and vice versa. As a result, the switching points become less noticeable.

Figure 10:
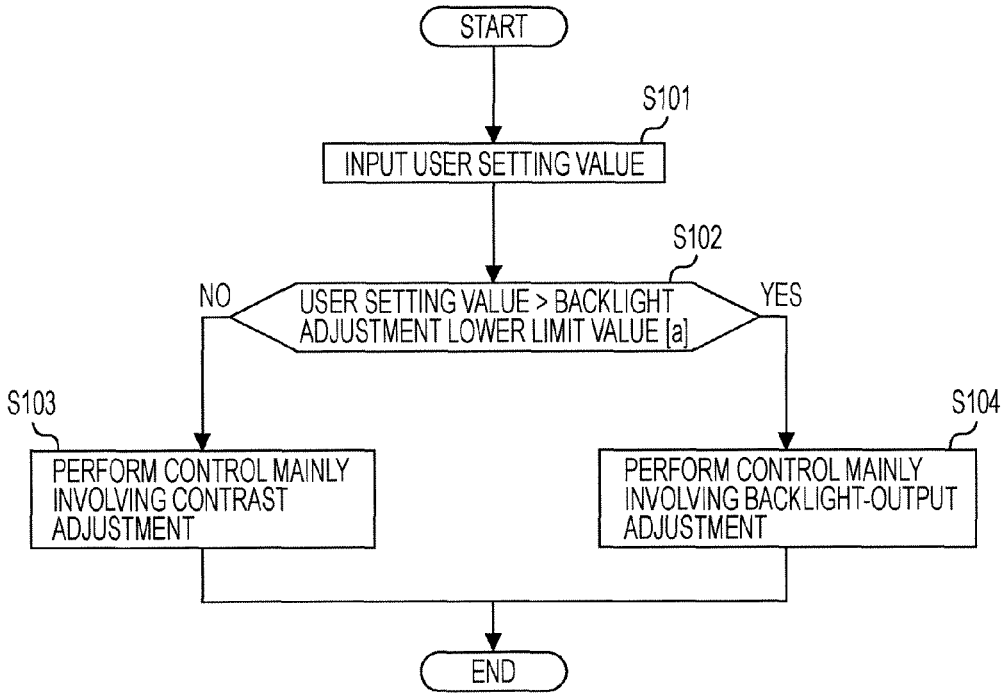
FIG. 10 is a flowchart of the sequence of a display-unit control process according to the embodiment.

FIG. 10 is a flowchart of a basic liquid-crystal-display control process performed by the liquid crystal display apparatus according to the embodiment of the present invention. As has been described with reference to FIGS. 4A to 9B, various processes serving as specific brightness control processes are applicable. FIG. 10 is a flowchart of the basic control sequence of an exemplary process.

In step S101, a user setting value is input. For example, the controller 120 receives a setting value entered by a user through the adjustment unit 110 of the exemplary structure illustrated in FIG. 5. In step S102, it is determined whether the user setting value is greater than a backlight adjustment lower limit value [a]. The backlight adjustment lower limit value [a] is, for example, the adjustment-unit input value [a] shown in FIGS. 3A and 3B, at or below which the brightness of the backlight is difficult to be reduced. This determination processing is performed as the processing performed by, for example, the adjustment-unit input-value determining unit 121 or the control-object determining unit 122 of the controller 120 shown in FIG. 5.

In the case where it is determined in step S102 that the user setting value is not greater than the backlight adjustment lower limit value [a], the flow proceeds to step S103, and a control operation of mainly adjusting the contrast is performed. In contrast, in the case where it is determined in step S102 that the user setting value is greater than the backlight adjustment lower limit value [a], the flow proceeds to step S104, and a control operation of mainly adjusting the backlight is performed. These operations are performed as the processing performed by, for example, the control-object determining unit 122, the backlight-output adjustment unit 123, and the contrast adjustment unit 124 of the controller 120 shown in FIG. 4.

As has been described with reference to FIGS. 4A to 9B, various processes serving as specific brightness control processes are applicable. That is, various processes including a process in which only one of the backlight-output adjustment and the contrast adjustment is performed in accordance with a user setting value, a process in which both the backlight-output adjustment and the contrast adjustment are performed in accordance with a user setting value, and a process additionally involving a control operation performed by the γ correction circuit can be performed. In any of these processes, a control operation of adjusting the contrast is performed in the case where the control point [P] corresponding to the adjustment-unit input value is at or below the lower limit of the backlight-output adjustment. With the adjustment processing described above, display data with high visibility can be output even in a dark environment.

Figure 11:
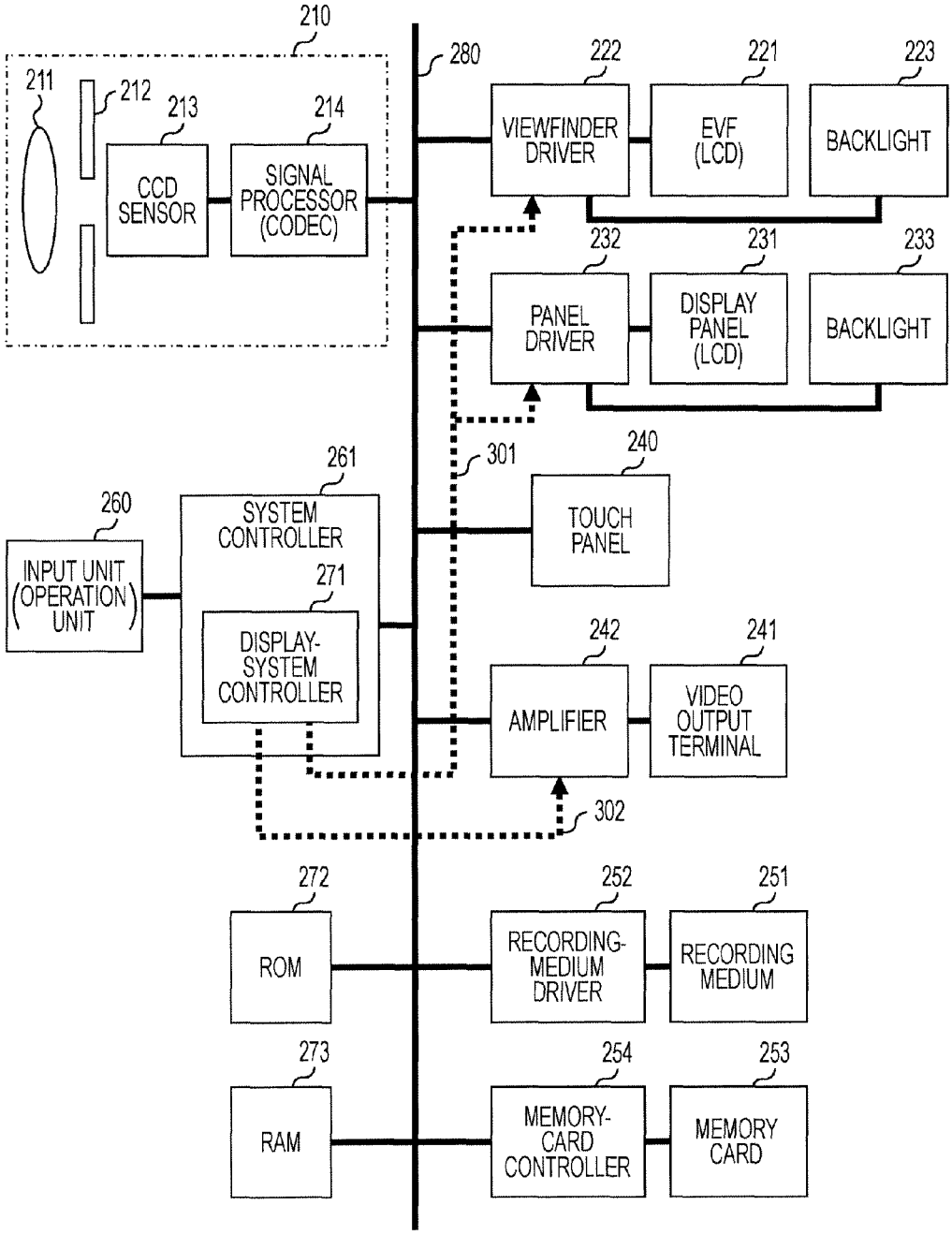
FIG. 11 is a block diagram of an exemplary structure of an apparatus configured to perform a display-unit control process according to the embodiment.

An exemplary structure of a digital camera serving as an example of a specific apparatus configured to perform the above-described liquid-crystal-display control process will be described. FIG. 11 is a block diagram of an exemplary structure of a digital camera configured to perform the above-described liquid-crystal-display control process.

The digital camera illustrated in FIG. 11 is configured to capture moving images and still images and to record the captured image data. The digital camera includes a camera block 210, an electrical viewfinder (EVF) 221 configured to perform a liquid crystal display operation, a viewfinder driver 222 configured to perform a display control operation including the controlling of the contrast of the EVF 221 and output adjustment of a backlight 223, a large (a few inches by a few inches) liquid crystal display panel (hereinafter referred to as a "display panel") 231 placed on the back of the camera and configured to perform a liquid crystal display operation, and a panel driver 232 configured to perform a display control operation including the controlling of the contrast of the display panel 231 and output adjustment of a backlight 233.

Further, the digital camera includes a touch panel 240 configured to input operation information and setting information entered by a user, a video output terminal 241, an amplifier 242, a recording medium 251, a recording-medium driver 252, a memory card 253, a memory-card controller 254, an input unit (operation unit) 260 configured to input operation information and setting information entered by a user, a system controller 261 configured to control the overall apparatus, a read-only memory (ROM) 272, and a random-access memory (RAM) 273. The system controller 261 includes a display-system controller 271.

The input unit 260 or the touch panel 240 includes an input unit configured to set a brightness adjustment value of the EVF 221 or the display panel 231. The display-system controller 271 of the system controller 261 performs the process described with reference to the flowchart of FIG. 10 in accordance with a setting value entered through the input unit 260 or the touch panel 240. That is, the display-system controller 271 allows the viewfinder driver 222 and the panel driver 232 to perform the adjustment of the contrast or the backlight output in accordance with a user input value, thereby performing a display control and brightness adjustment operation on the EVF 221 and the display panel 231.

The flow of a process performed by the camera shown in FIG. 11 will be described. The camera block 210 includes a lens 211, a diaphragm 212, a charge-coupled device (CCD) sensor 213, and a signal processor or coder-decoder (CODEC) 214. The CCD sensor 213 forms an image of an object through the 211 and the diaphragm 212. The signal processor 214 performs various signal processes on an image signal of the image (which may be a moving image or a still image) captured by the CCD sensor 213 and converts the signal into image signals in various formats.

The EVF 221 is a liquid crystal display configured to display an image captured by the CCD sensor 213. The viewfinder driver 222 drives the EVF 221 on the basis of control information supplied from the display-system controller 271 of the system controller 261. The display panel 231 displays an image captured by the CCD sensor 213 and an image stored on the recording medium 251 and also displays status information and setting information of the digital camera.

Display control operations for these display units are performed in accordance with the process described with reference to the flowchart of FIG. 10. That is, the contrast adjustment or the backlight-output adjustment is performed in accordance with a setting value entered through the input unit 260 or the touch panel 240, thereby performing a display control and brightness adjustment operation on the EVF 221 and the display panel 231. Various control procedures described with reference to FIGS. 4A to 9B are applicable as specific control procedures, and each of the control operations is performed using one of these procedures.

That is, the system controller 261 controls the elements of the digital camera on the basis of operation information entered through the touch panel 240 and the input unit 260. The ROM 272 stores programs executed by the system controller 261, data, and parameters applied in execution of the programs. The RAM 273 is used as a work memory for the system controller 261. The display-system controller 271 of the system controller 261 controls the viewfinder driver 222, the panel driver 232, and the amplifier 242. The viewfinder driver 222 and the panel driver 232 are connected to the display-system controller 271 via a common control signal line 301. The amplifier 242 is connected to the display-system controller 271 via a control signal line 302.

The backlight 233 for the display panel 231 sends a direct current (DC) voltage obtained using a backlight current detection circuit (not shown) as a feedback to the display-system controller 271 of the system controller 261, and the display-system controller 271 controls the brightness of the display panel 231 on the basis of this feedback data and a user setting value.

The backlight 223 for the EVF 221 sends a DC voltage obtained using a backlight current detection circuit (not shown) as a feedback to the display-system controller 271 of the system controller 261, and the display-system controller 271 controls the brightness of the EVF 221 on the basis of this feedback data and a user setting value.

In the case where the user wants to change the brightness of these display units, it is only necessary for the user to enter a setting value through the input unit 260 or the touch panel 240. On the basis of the setting value entered, the display-system controller 271 of the system controller 261 outputs control signals to the viewfinder driver 222 and the panel driver 232 in accordance with the flow described with reference to FIG. 10, thereby controlling the brightness of the display panel 231 and the EVF 221. Various control procedures described with reference to FIGS. 4A to 9B are applicable as specific control procedures, and the control operation is performed using one of these procedures.

The touch panel 240 is integrated with the display panel 231 and inputs operation information entered by a user on the basis of an operation screen displayed on the display panel 231. The video output terminal 241 outputs an image captured by the CCD sensor 213 or an image recorded on the recording medium 251 as an analog video signal. The amplifier 242 amplifies the video signal.

The recording medium 251 includes, for example, a magnetic tape, an optical disk, or a hard disk, and records images (mainly moving images) captured by the CCD sensor 213. The recording-medium driver 252 controls the operation of the recording medium 251. The memory card 253 stores images (mainly still images) captured by the CCD sensor 213. The memory-card controller 254 controls the operation of the memory card 253. The input unit (operation unit) 260 includes operation keys, an operation lever, or the like, and inputs operation information entered by a user.

The camera block 210, the viewfinder driver 222, the panel driver 232, the touch panel 240, the amplifier 242, the recording-medium driver 252, the memory-card controller 254, the system controller 261, the ROM 272, and the RAM 273 are interconnected via a bus 280.

The present invention has been described in detail in the context of specific embodiments. However, it is obvious for those skilled in the art to make modifications or alternatives without departing from the scope of the present invention. That is, the present invention has been disclosed by way of example, and the present invention should not be construed as limited to the embodiments. The scope of the present invention should be determined on the basis of the claims.

The series of processes described herein can be executed by hardware, by software, or by a combination of hardware and software. In the case where the series of processes is executed by software, a program defining the processing sequences is executed by installing it on a memory of a computer embedded in dedicated hardware or on a general-purpose computer that is capable of executing various processes.

For example, the program may be recorded in advance on a recording medium such as a hard disk or a ROM. Alternatively, the program may be stored (recorded) temporarily or permanently on a removable recording medium such as a flexible disk, a CD-ROM, an MO disk, a digital versatile disc (DVD), a magnetic disc, or a semiconductor memory. Such a removable recording medium can be provided in the form of what is called packaged software.

Besides installing the program from the above-described removable recording medium to the computer, the program may be transferred wirelessly from a download site to the computer, or transferred by wire to the computer via a network such as a local area network (LAN) or the Internet, so that the computer can receive the program transferred in this manner and install the program on an internal recording medium such as a hard disk.

The processes described in this specification may be executed in a time-series manner according to the description, or may be executed in parallel or individually in accordance with the processing performance of an apparatus configured to execute the processes or according to the necessity.

What is claimed is:

1. A liquid crystal display apparatus including a liquid crystal display as a display unit, the apparatus comprising:

a backlight configured to illuminate the display unit from the back of the apparatus in accordance with an output level; and a controller configured to receive display-unit-brightness specifying information specifying a brightness level, the brightness specifying information input from a user input unit, the controller further configured to adjust the output level of the backlight and adjust a Y gain level of display data for the display unit in accordance with the brightness specifying information, and the controller further configured to compare the brightness specifying information input by a user with a plurality of predetermined thresholds, and upon determination that the brightness specifying information specifies the brightness level less than or equal to a first predetermined threshold from the plurality of predetermined thresholds, adjust the Y gain level of the display data for the display unit while the output level of the backlight remains constant, and upon determination that the brightness specifying information specifies the brightness level above the first predetermined threshold and below than or equal to a second predetermined threshold from the plurality of thresholds, adjust both the Y gain level of the display data for the display unit and the output level of the backlight, the second predetermined threshold higher than the first predetermined threshold, and upon determination that the brightness specifying information specifies the brightness level above a third predetermined threshold from the plurality of thresholds, adjust the Y gain level of the display data for the display unit while the output level of the backlight remains constant, the third predetermined threshold higher than the second predetermined threshold.

2. The liquid crystal display apparatus according to claim 1, wherein the controller is configured to adjust the Y gain level of the display data for the display unit upon determination that the output level of the backlight corresponding to the brightness level specified by the brightness specifying information is at or below a backlight adjustable minimum output level.

3. The liquid crystal display apparatus according to claim 1, wherein the controller is configured to perform, selectively or in parallel, (a) adjustment of the output level of the backlight, and (b) adjustment of the Y gain level of the display data for the display unit, in accordance with the brightness specifying information input by the user.

4. The liquid crystal display apparatus according to claim 1, wherein the controller is configured to perform at least one of (a) adjustment of the output level of the backlight, and (b) adjustment of the Y gain level of the display data for the display unit, and, to perform (a) and (b) in parallel at a point at which the adjustment being performed is switched from (a) to (b) or from (b) to (a).

5. The liquid crystal display apparatus according to claim 1, wherein the controller is configured to control the brightness level of the display unit by performing a signal control operation of boosting a halftone portion using a gamma correction circuit included in the liquid crystal display apparatus.

6. The liquid crystal display apparatus according to claim 1, wherein, upon determination that (1) the display unit is changed from a bright state to a dark state, and (2) the display unit is changed from the dark state to the bright state, the controller is configured to perform, selectively or in parallel, (a) adjustment of the output level of the backlight, and (b) adjustment of the Y gain level of the display data for the display unit, and, to set the point at which the adjustment being performed is switched from (a) to (b) or from (b) to (a) and the point at which (a) and (b) are performed in parallel to be different in (1) and (2).

7. A liquid-crystal-display control method for performing, with a liquid crystal display apparatus including a liquid crystal display as a display unit, a control operation on the display unit, comprising the step of:

receiving, with a controller, display-unit-brightness specifying information specifying a brightness level, the brightness specifying information input from a user input unit;

adjusting an output level of a backlight that illuminates the display unit from the back of the apparatus;

adjusting a Y gain level of display data for the display unit in accordance with the brightness specifying information;

comparing the brightness specifying information input by a user with a plurality of predetermined thresholds;

adjusting the Y gain level of the display data for the display unit while the output level of the backlight remains constant upon determination that the brightness specifying information specifies the brightness less than or equal to a first threshold from the plurality of predetermined thresholds;

adjusting both the Y gain level of the display data for the display unit and the output level of the backlight upon determination that the brightness specifying information specifies the brightness level above the first predetermined threshold and below than or equal to a second predetermined threshold from the plurality of thresholds, the second predetermined threshold higher than the first predetermined threshold; and adjusting the Y gain level of the display date for the display unit while the output level of the backlight remains constant upon determination that the brightness specifying information specifies the brightness level above a third predetermined threshold from the plurality of thresholds, the third predetermined threshold higher than the second predetermined threshold.

8. The liquid-crystal-display control method according to claim 7, wherein the Y gain of the display data for the display unit is adjusted upon determination that the output level of the backlight corresponding to the brightness level specified by the brightness specifying information is at or below a backlight adjustable minimum output level.

9. The liquid-crystal-display control method according to claim 7, wherein (a) adjustment of the output level of the backlight and (b) adjustment of the Y gain level of the display data for the display unit are performed selectively or in parallel in accordance with the brightness specifying information input by the user.

10. A non-transitory computer readable storage medium having executable instructions stored therein, which when executed by a processor in a liquid crystal display apparatus including a liquid crystal display as a display unit causes the processor to perform a control operation on the display unit, the control operation comprising the step of:

adjusting, by a controller, an output level of a backlight that illuminates the display unit from the back of the apparatus and a Y gain level of display data for the display unit in accordance with brightness specifying information input from a user input unit, the brightness specifying information input specifying a brightness level;

comparing, by the controller, the brightness specifying information input by a user with a plurality of predetermined thresholds;

adjusting the Y gain level of the display data for the display unit while the output level of the backlight remains constant upon determination that the brightness specifying information specifies the brightness level less than or equal to a first threshold from the plurality of predetermined thresholds;

adjusting both the Y gain level of the display data for the display unit and the output level of the backlight upon determination that the brightness specifying information specifies the brightness level above the first predetermined threshold and below than or equal to a second predetermined threshold from the plurality of thresholds, the second predetermined threshold higher than the first predetermined threshold; and adjusting the Y gain level of the display date for the display unit while the output level of the backlight remains constant upon determination that the brightness specifying information specifies the brightness level above a third predetermined threshold from the plurality of thresholds, the third predetermined threshold higher than the second predetermined threshold.

* * * * *